US008208825B2

(12) United States Patent
Mao

(10) Patent No.: US 8,208,825 B2
(45) Date of Patent: Jun. 26, 2012

(54) ELECTROSTATOGRAPHIC PRINTING MACHINE

(75) Inventor: Minghua Mao, South Australia (AU)

(73) Assignee: Xeikon IP BV, GZ Eede (NL)

( * ) Notice: Subject to any disclaimer, the term of this patent is extended or adjusted under 35 U.S.C. 154(b) by 224 days.

(21) Appl. No.: 12/449,535

(22) PCT Filed: Feb. 11, 2008

(86) PCT No.: PCT/AU2008/000168

§ 371 (c)(1),
(2), (4) Date: Aug. 12, 2009

(87) PCT Pub. No.: WO2008/098285

PCT Pub. Date: Aug. 21, 2008

(65) Prior Publication Data

US 2010/0054777 A1 Mar. 4, 2010

(30) Foreign Application Priority Data

Feb. 12, 2007 (AU) ..... 2007900689

(51) Int. Cl.
*G03G 15/06* (2006.01)

(52) U.S. Cl. ..... 399/55; 399/57; 399/238; 399/240

(58) Field of Classification Search ..... 399/55, 399/57, 238, 240
See application file for complete search history.

(56) References Cited

U.S. PATENT DOCUMENTS

| | | | | |
|---|---|---|---|---|
| 5,826,148 | A * | 10/1998 | Iino et al. | 399/240 |
| 5,987,282 | A * | 11/1999 | Tsukamoto et al. | 399/237 |
| 2005/0069349 | A1 * | 3/2005 | Nakamura et al. | 399/237 |
| 2007/0077076 | A1 * | 4/2007 | Yoshida | 399/27 |
| 2007/0248375 | A1 * | 10/2007 | Nakazawa | 399/88 |

* cited by examiner

*Primary Examiner* — David Porta
*Assistant Examiner* — Benjamin Schmitt
(74) *Attorney, Agent, or Firm* — Klauber & Jackson, LLC

(57) ABSTRACT

An electrostatographic printing machine has a liquid toner supply chain incorporating at least a toner supply device (10), a metering roller (21) and a development member (31) and an image carrying member (41). An electrostatic charging device (33) acts onto the development member to impress an electrostatic charge onto the development member and to induce a voltage thereon with respect to a machine electrical common earth potential. The toner supply roller, the metering roller and the developer member are each electrically connected to the machine electrical common earth potential (37) via a respective voltage regulating or controlling means (25, 27, 35) to regulate or control induced voltages on each of the toner supply roller, the metering roller and the developer member.

8 Claims, 7 Drawing Sheets

ELECTROSTATOGRAPHIC PRINTING MACHINE

CROSS REFERENCE TO RELATED APPLICATIONS

The present application is a National Stage Application claiming the priority of co-pending PCT Application No. PCT/AU2008/000168 filed Feb. 11, 2008, which in turn, claims priority from Australian Application Serial. No. 2007900689, filed Feb. 12, 2007. Applicants claim the benefits of 35 U.S.C. §120 as to the PCT application and priority under 35 U.S.C. §119 as to the said Australian application, and the entire disclosures of both applications are incorporated herein by reference in their entireties.

FIELD OF INVENTION

This invention relates to electrostatography, and more particularly to a method and means for image development utilising highly viscous, highly concentrated liquid developers.

BACKGROUND OF THE INVENTION

A non-impact printing process can be simply defined as a process which uses an electronic, electric, magnetic or optical means to produce characters as opposed to a mechanical means. Of the non-impact printing processes, there is a group of printing methods that uses electrostatic techniques. Electrostatic printing can be defined as those methods which use the interaction of electrostatically charged marking particles and an electric field to control the deposition of the marking particles onto a substrate, and encompasses processes generally known as electrographic, electrophotographic, or electrostatographic printing.

Electrostatography can be a term used to describe the various non-impact printing processes which involve the creation of a visible image by the attraction of charged imaging particles or marking particles to charged sites present on a substrate. Such charged sites, forming what is usually termed a latent image, can be transiently supported on photoconductors or pure dielectrics and may be rendered visible in situ or be transferred to another substrate to be developed in that location. Additionally such charged sites may be the reflection of those structured charges existing within a permanently polarised material as in the case with ferroelectrics or other electrets.

In electrostatography the imaging particles, generally known as toner, can be of the dry type or of the liquid type. Dry powder toners have many disadvantages. For example the performance of dry powder toners is very susceptible to environmental conditions, influencing, for example, charge stability, and therefore giving rise to variable image performance. Also, the large particle size of dry powder toners is a major contributing factor in not allowing the achievement of highly resolved developed images.

Other objections are related to the problem of dusting. Dust or fine or small particles of toner are prone to escape from the developer, and these deposit onto any surface both within and outside the printing device, causing mechanical failures within the device and environmental problems outside the device. This problem becomes severe when such dry powder printing devices are run at higher speeds. In addition, achieving high resolution with dry powder toners at higher speeds is difficult due to the fact that the dusting problem is further exacerbated by the need to reduce dry toner particle size to a level which will allow acceptable resolution at high speeds, which further compounds the difficulty and dangers in handling such fine powders. Dry powder systems therefore can not in practice achieve high resolution images that are usually associated with analogue printing methods such as off-set and gravure printing. Other disadvantages include cost of the general maintenance of the printer and cost of the dry powder toner.

It is known that latent electrostatic images can be developed with marking particles dispersed in insulating or non-polar liquids. Such marking particles normally comprise colouring matter such as pigments which have been ground with or otherwise combined with resins or varnishes or the like. Additionally, charge directing agents are usually included to control the polarity and charge-to-mass ratio of the toner particles. These dispersed materials are known as liquid toners or liquid developers. In use, a liquid developer is applied to the surface of a latent image bearing member to develop an electrostatic image on the member.

Liquid toner development systems are generally capable of very high image resolution because the toner particles can safely be much smaller, normally in the range of 0.5 to 3 μm, than dry toner particles which are normally in the range of 7 to 10 μm. Liquid toner development systems show impressive grey scale image density response to variations in image charge and achieve high levels of overall image density. Additionally, the systems are usually inexpensive to manufacture and are very reliable. Furthermore, the liquid toners for these systems are operationally and chemically stable, particularly to environmental changes due to buffering properties of the carrier liquid, thus exhibiting a particularly long shelf-life.

Liquid developers have generally utilized volatile low viscosity liquids and low concentration of the solids, that is, of marking particles. These traditional toners and associated process systems may be termed low viscosity toner or LVT systems. Generally, LVT systems utilise toners with low viscosities, typically 1 to 3 mPa·s. and low volumes of solids, typically 0.5 to 2% by weight. Maintaining a uniform dispersion of the marking particles can be difficult in a low viscosity toner system. The marking particles have a tendency to drift and settle in the carrier liquid. Furthermore, low volume of solids in the toner increases the amount of toner required to develop a given latent image. More liquid toner will have to be presented to the photoconductor surface in order to provide sufficient marking particles for a desired image density. In order to meet this toner supply demand, LVT printing systems are usually designed to have reasonably large development gaps. Such an arrangement of the development region has several drawbacks, such as a reduced strength and uniformity of the electric field in the development gap, and additional complexity in the design required to maintain a constant gap in the printing direction, as well as across the page. This usually results in reduced development efficiency, edge effects and non-uniform solid fill.

Devices using such liquid electrographic printing can also have some objectionable problems. The main problem is in regard to the carrier liquid carry-out. The term carrier liquid carry-out relates to the quantity of carrier liquid which is transferred onto and trapped within the paper. Such carrier liquid subsequently evaporates during image fusing, giving rise to atmospheric pollution and also adding significantly to production costs. A further disadvantage of such liquid toning is the tendency for deposition of colouring matter in non-image or background areas which results in a general discolouration of the copy, normally referred to as background staining or fog.

To overcome these and other known problems that can be associated with LVT systems, highly concentrated liquid toner development systems utilising toner with solids concentrations of up to 60% by weight and viscosities of up to 10,000 mPa·s, and utilizing thin films, typically 1 to 40 μm, of the highly concentrated and viscous liquid toner have been disclosed. This system of developing electrostatic latent images with these viscous and highly concentrated liquid toner systems may be termed high viscosity toner or HVT systems. Examples of such liquid toners are disclosed in commonly assigned U.S. Pat. No. 5,612,162 to Lawson et al., and U.S. Pat. No. 6,287,741 to Marko, the disclosures of which are totally incorporated herein by reference. Examples of high viscosity, high concentration liquid developing methods and apparatus are disclosed in commonly assigned U.S. Pat. No. 6,137,976 to Itaya et al. and U.S. Pat. No. 6,167,225 to Sasaki et al., and PCT/AU2006/001307, the disclosures of which are totally incorporated herein by reference. These new HVT liquid developing systems overcome many of the shortcomings of traditional LVT systems.

The abovementioned prior art describes methods of HVT printing traditionally utilising a number of supply rollers to present to a charged imaging member a thin layer of highly concentrated viscous toner, nominally in the order of 1 to 40 μm. In this prior art, these supply rollers may transport the liquid developer to the imaging member with the assistance of bias voltages supplied by a number of power supplies connected to the associated supply or feeder rollers.

It has been surprisingly found however that it is possible to supply a thin controlled layer of high viscosity high solids content toner by the use of a feeder roller system which comprises a train of rollers, without the use of power supplies to create a voltage differential between the rollers, to move the electrostatically charged liquid toner particles to the latent image on the imaging member.

It is therefore an objective of this invention to provide a device for and a method of image development that minimises the use of traditionally electrically biased supply rollers.

Such a method of developing electrostatic latent images simplifies print engine design, reduces manufacturing costs as well as reducing overall running costs of the electrographic printing system.

BRIEF DESCRIPTION OF THE INVENTION

In one form therefore, the invention is said to reside in an electrostatic printing machine comprising a toner supply chain incorporating at least a toner supply device, a metering roller and a development member and an image carrying member, an electrostatic charging device acting onto the development member to impress an electrostatic charge onto the development member and to induce a voltage thereon with respect to a machine electrical common earth potential, wherein the toner supply roller, the metering roller and the developer member are each electrically connected to the machine electrical common earth potential via a respective voltage regulating or controlling means to regulate or control induced voltages on each of the toner supply roller, the metering roller and the developer member.

It has been found that the electrostatic charging device acting onto the development member which also works as a carrier liquid displacement device acting upon the thin layer of liquid toner on the development member can supply the voltage differential between the rollers to assist in moving the electrostatically charged liquid toner particles to the latent image on the imaging member. A voltage with respect to machine earth is induced onto the development member and the toner supply roller and the metering roller also have a voltage with respect to machine earth induced onto them by, it is assumed, conduction through the carrier film during use. The amount of the induced voltage can be controlled on each roller of member by the respective voltage regulating or controlling means. Additionally, it has been found that by using a voltage regulating or control means as described herein, allows for the significant lowering of the surface voltage potential on the imaging member without the loss of image quality or increased background noise; indeed, the image quality and image density increase. The lowering of the latent image surface voltage on the imaging member has the additional benefit of decreasing potential photoconductor fatigue which is associated with high charging voltages. The lowering of the surface potential on the imaging member increases the useable life of the photoconductor. Further, the simplified system described herein, allows for significantly reduced hardware and maintenance costs, especially in the office automation area where the total cost of ownership can be significantly reduced with the present invention.

Each of the voltage regulating or control means may comprise a resistor, a variable resistor, a zener type diode or a programmable voltage regulation circuit.

The electrostatic charging device acting onto the development member to impress an electrostatic charge onto the development member may be selected from a carrier liquid displacement device, a corona discharge device or a carrier liquid displacement roller bearing against the development member and having a voltage applied to it of from +50 to +1500 volts.

In an alternative form the invention comprises an electrostatic printing machine comprising;

(a) a toner supply device to supply a toner comprising a carrier and toner particles to a toner supply roller;
(b) a metering roller which receives a thin layer of the toner from the toner supply roller;
(c) a development member and an electrostatic charging device acting onto the development member to impress an electrostatic charge onto the development member and to induce a voltage thereon with respect to a machine electrical common earth potential;
(d) the metering roller bearing against the development member to transfer a thin layer of the toner onto the development member;
(e) an image carrying member having a surface adapted to retain an electrostatic latent image thereon and an electrostatic charging device acting onto the image carrying member to impress an electrostatic charge onto the image carrying member;
(f) an image forming stage in which the electrostatic charge is formed into an electrostatic latent image on the image carrying member;
(f) the development member engaging against the image carrying member;
(g) a development stage in which toner particles in the thin layer on the development member are transferred to the image carrying member under the influence of the electrostatic latent image on the image carrying member to provide a developed image thereon; and
(h) a transfer stage in which the developed image is transferred from the image carrying member onto a substrate, wherein the toner supply roller, the metering roller and the developer member are each electrically connected to the machine electrical common earth potential via a respective voltage regulating or controlling means to regulate or control a voltage on each of the toner supply roller, the metering roller and the developer member.

Each of the voltage regulating or control means may comprises a resistor, a variable resistor, a zener type diode or a programmable voltage regulation circuit.

The electrostatic charging device acting onto the development member to impress an electrostatic charge onto the development member may be selected from a carrier liquid displacement device, a corona discharge device or a carrier liquid displacement roller bearing against the development member and having a voltage applied to it of from +50 to +1500 volts.

Preferably the electrostatic printing machine can further include a pick-up roller between the toner supply roller and the metering roller and which is spaced from the supply roller by a first feed gap and spaced from the metering roller by a second feed gap.

Preferably the high viscosity toner comprises a concentration of chargeable marking particles of up to 60% by weight in a non-conductive carrier liquid, more preferably the high viscosity toner comprises a concentration of chargeable particles of from 5 to 40% by weight.

Preferably the high viscosity toner exhibits a viscosity of 10 mPa·s to 10,000 mPa·s, more preferably the toner exhibits a viscosity of 10 mPa·s to 5,000 mPa·s., even more preferably the toner exhibits a viscosity of 20 mPa·s to 1,000 mPa·s.

Preferably the first feed gap between the toner supply roller and the pick-up roller is from 10 to 500 μm and the second feed gap between the pick-up roller and the metering roller is from 50 to 400 μm.

There can be further included a feeder roller between the metering roller and the development member, the feeder roller being driven to rotate at a speed and or direction which is different to the speed and or direction of the development member.

In one embodiment the image forming stage comprises an image carrying member having a surface adapted to retain an electrostatic charge thereon, a charging device to provide a uniform electrostatic charge to the surface and a discharge device to selectively discharge the uniform electrostatic charge to form the electrostatic latent image thereon. The surface of the image carrying member can comprise a photoconductor and the discharge device can comprise an illumination device.

Alternatively, the image forming stage comprises an image carrying member having a dielectric surface adapted to retain an electrostatic charge thereon and a selective charging device to provide a selected electrostatic charge to the surface to form the electrostatic latent image thereon.

In one embodiment, the electrostatic image on the image carrying member may have non-image regions at a potential of from +200 to +900 volts and image regions at a potential of from +0 to +150 volts.

Preferably, the toner supply comprises a pair of counter rotating gears feeding the high viscosity toner to the toner supply roller.

Other means of toner supply may be utilised, for example a slit coating chamber mechanism delivering the toner through the slit directly onto the surface of a roller.

Alternatively, the toner supply may simply comprise a partially immersed roller in the high viscosity toner, as a means of delivering the toner to the surface of a roller.

Preferably, the pick-up roller is a metal roller. The pick-up roller may also comprise an elastomer coated roller with polyurethane or NBR or other suitable material.

There may be provided a doctor blade bearing against the pick-up roller to provide a layer of the high viscosity toner on the pick-up roller of from 100 to 2000 μm thick.

The primary purpose of the pick-up roller is to limit and control the amount of toner that is delivered onto the surface of the metering roller, particularly at the increased toner supply rates associated with high speed printing.

In an alternative embodiment the pick-up roller may be excluded and the toner is supplied directly onto the metering roller by a toner supply mechanism.

Preferably, the patterned metering roller comprises a patterned roller, raster roller or more preferably, the patterned metering roller comprises an Anilox roller. The pattern on the Anilox roller may be selected from trihelical and Z-channel and may have a line resolution of from 150 to 300 lines per inch and a pattern depth of from 20 to 50 μm. Preferably, the Anilox roller has a trihelical pattern configuration, a resolution of 200 lines per inch and a pattern depth of 30 μm. Other Anilox type patterns however may also be used on the metering roller, and including random patterns.

The development member may be held at an electrical potential of from +50 to +800 volts.

The interference fit of the metering roller against the development member may be from 50 to 5000 μm. The interference fit of the development member against the image carrying member may be from 50 to 5000 μm.

The carrier liquid displacement device is placed in a position adjacent to the development member, and a corona producing voltage, in the case where a corona generating device is used, is applied to establish an electric field across the toner layer and through electrophoretic movement of the charged toner particles create a spatial separation of the toner particles and the carrier liquid within the toner deposit, whereby the carrier liquid is displaced to the surface of the toner layer, and therefore, if required, acts as a pre-wet layer. Another effect of the carrier liquid displacement device is to adjust or reinforce the charge on the individual toner particles and provide additional particle compaction for enhanced density uniformity of the developed image. Such toner material of accurately controlled polarity and density when presented to the latent image allows for the development of images to very uniform density and devoid of background stain, without the need for any form of additional pre-wet system.

Hence, in one embodiment the carrier liquid displacement device comprises a corona discharge device. The voltage applied to the corona discharge device being of a sufficient order to create a corona discharge, and this may be up to several thousand volts of the appropriate polarity. Alternatively, the carrier liquid displacement device comprises a roller type mechanism bearing with an interference fit against the development member and having a voltage applied to it of from +50 to +1500 volts. The carrier liquid displacement roller bearing against the development member may have a smooth surface finish or it may have a patterned surface, and in one embodiment, the carrier liquid displacement roller may be an Anilox type roller. The carrier liquid displacement roller bearing against the development member can also be adapted to simultaneously remove excess carrier from the development member, whereby the excess liquid can be scraped off the carrier liquid displacement roller by a scraper blade positioned against the roller.

The development stage may comprise discharged area development (DAD) or charged area development (CAD).

There may be further provided an intermediate transfer stage in which the developed image is transferred from the image carrying member to an intermediate transfer member before being transferred to the substrate. The final transfer stage would then comprise the developed image being transferred from the image carrying member to the intermediate transfer member and then from the intermediate transfer member onto the substrate.

There may be an interference fit between the image carrying member and the intermediate transfer member to give a selected contact time therebetween. The interference fit of the image carrying member against the intermediate transfer member may be from 50 to 5000 μm.

The intermediate transfer member may be held at an electrical potential of from −50 to −2000 volts.

There may be further provided an erasing stage in which any remaining electrostatic image on the image carrying member is erased.

There may be further provided a cleaner stage in which any unused toner on the development member after the selective transfer to the image carrying member is cleaned off the development member. This unused toner may be recycled to a toner supply or to a recycling and replenishment system.

There may be further provided a cleaner stage in which any residual toner on the image carrying member after the transfer to the final transfer stage is cleaned off the image carrying member.

There may be further provided a cleaner stage in which any residual toner on the intermediate transfer member after the transfer to the final transfer stage is cleaned off the intermediate transfer member.

Each of the cleaner stages can comprise a cleaning brush roller and a smooth elastomer cleaning blade each side of the brush roller engaged against the image carrying member or the intermediate transfer member.

Alternatively, each of the cleaner stages can comprise a smooth surfaced cleaning roller and a smooth elastomer cleaning blade engaged against the image carrying member or the intermediate transfer member.

The cleaner roller can comprise a roller selected from the group comprising an elastomer coated roller or a highly polished metal roller.

The cleaner stage can further comprises a flush fluid supply to lubricate the cleaning roller and cleaning blade and to dilute cleaner residue for ease of recycling.

There may be further provided an image fixing stage in which the image on the substrate is fixed. Preferably, the image fixing stage uses heat and compression between rollers. Alternatively, the image fixing stage uses non-contact methods such as IR, UV and EB curing or other known methods of image fusing.

The development member, the pick-up roller, the metering roller and the toner supply roller may be held at the same voltage. There may be further provided a voltage differential between the rollers to enhance selective transfer of the toner particles and or to enable the change in the toner splitting ratio between the rollers, hence allowing the adjustment of the toner layer thickness on the development member.

Preferably, the image carrying member is a drum with a photoconductive surface selected from the group comprising α-silicon, organic photoconductor or $As_2Se_3$.

Preferably, the development member is selected from the group comprising a roller or a belt.

There may be further provided a pressure roller behind the substrate at the final transfer stage.

Preferably, there can be provided a set screw arrangement or a cam mechanism engaging a shaft of the metering roller to engage the metering roller against the development member to set the amount of the interference fit.

The substrate may be selected from the group comprising of sheet fed substrates or a continuous web. The substrate may comprise paper or other printable surface such as, for example, plastic films, metal, and other such materials.

Preferably, the toner is formed by dispersing marking particles in a dielectric liquid such that the liquid developing agent has a viscosity of up to 10,000 mPa·s, even more preferably, the toner exhibits a viscosity of 20 mPa·s to 1,000 mPa·s.

The thin layer of the toner transferred onto the development member may have a thickness of from 1 to 40 atm.

In a further form the invention may be said to reside in a method of high speed toning comprising the steps of;

(a) forming an electrostatic latent image on an image carrying member;

(b) forming a film of a toner on the surface of a development member, the toner having a viscosity of up to 10,000 mPa·s, and a concentration of chargeable particles of up to 60% by weight in a non-conductive carrier liquid;

(c) imposing an electric field through the film of toner on the surface of the development member, thus forming a potential difference through the toner layer, whereby the film of toner splits into two spatially separated layers; one layer comprising an increased concentration of toner particles compacted close to the development member, and a second layer of carrier fluid positioned above the compacted toner layer, and substantially free from toner particles;

(d) bringing the development member with the spatially separated layers of liquid developing agent in contact with the image carrying member such that the second layer of carrier fluid positioned above the compacted toner layer acts as a pre-wet film on the surface of the image bearing member prior to the compacted toner layer developing the latent image, thereby fully developing the latent image on the image carrying member, without any background staining or fog;

(e) transferring the developed image from the image carrying member onto a further member or a final substrate; and (f) fixing the transferred image on the final substrate.

wherein the development member is connected to a machine earth via a regulating or controlling means to regulate or control the voltage on said member.

The step of imposing an electric field through the film of toner on the surface of the development member may be done by an electrostatic charging device acting onto the development member to impress an electrostatic charge onto the development member and may be selected from a carrier liquid displacement device, a corona discharge device or a carrier liquid displacement roller bearing against the development member and having a voltage applied to it of from +50 to +1500 volts.

The step of bringing the development member with the spatially separated layers of liquid developing agent in contact with the image carrying member can include holding the development member in contact with the image carrying member for a selected period of time by providing an interference fit between the development member and the image carrying member.

The development member can have the following range of characteristics:

| | |
|---|---|
| Roughness: | Rz ≦ 2 μm |
| Hardness of coating: | 10-70° Shore A and more preferably 50° Shore A |
| Surface energy: | 10-50 mN/m and more preferably 35 mN/m |
| Electrical resistivity: | $1 \times 10^4$-$1 \times 10^8$ Ω · cm and more preferably $1 \times 10^6$ Ω · cm |

The intermediate member can have the following range of characteristics:

| | |
|---|---|
| Roughness: | Rz ≦ 2 μm |
| Hardness of coating: | 10-70° Shore A and more preferably 60° Shore A |
| Surface energy: | 10-50 mN/m and more preferably 25 mN/m |
| Electrical resistivity: | $1 \times 10^4$-$1 \times 10^8$ Ω · cm and more preferably $1 \times 10^7$ Ω · cm. |

It has been found that an important factor in high speed HVT printing is to enable sufficient time for the development and transfer of the developed images. This time factor, for a given high speed system, is determined by roller diameters, print speed and the interference fit. Hence for the present invention there is a defined interference fit between the metering roller and the development member and between the development member and the imaging member.

In contrast, in a traditional resilient type of contact, what is being primarily controlled is the contact force. The development system of the present invention is not dependent on the force between the rollers, but strictly on the nip width. Also, having an interference fit in an HVT high speed print engine provides stable printing and prevent vibration of the rollers that could be originate from a resilient engagement. This can in fact lead, for example, to banding on the developed image due to the instability of the rollers caused by the resilient urging. Finally, a further advantage is that it is simpler to create a controlled contact between rollers by adjusting distances, rather than changing the force between the rollers.

As used herein the term "interference fit" means the contact between adjacent members or rollers created by setting a constant distance between shafts of the contacting rollers or members.

BRIEF DESCRIPTION OF THE DRAWINGS

This then generally describes the invention, but to assist with understanding reference will now be made to the accompanying drawings which show a preferred embodiment of the invention.

DETAILED DESCRIPTION OF PREFERRED EMBODIMENTS

Figure 1:
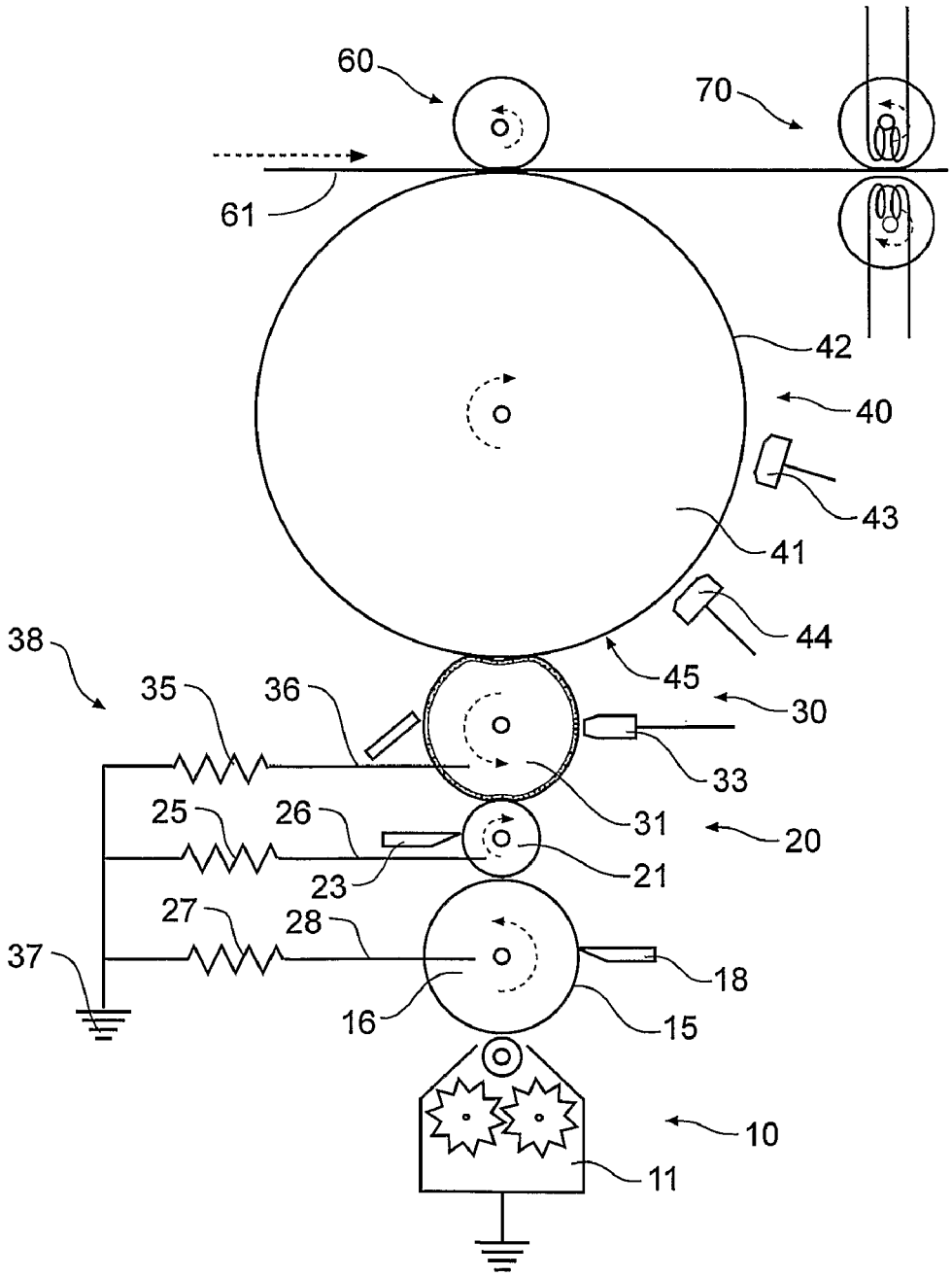
FIG. 1 shows a schematic representation of an electrostatic printing apparatus according to the present invention.

Now looking at FIG. 1, this drawing shows a schematic electrostatic printing apparatus according to the present invention.

In FIG. 1, the schematic electrostatic printing process generally has a toner supply stage 10, a toner metering apparatus 20, a development stage 30, an imaging stage 40, a transfer to substrate stage 60 and a fixing stage 70.

Toner is supplied by the toner supply stage 10 from a toner tank 11 to a pick-up roller or toner supply roller 16. The pick-up roller or toner supply roller 16 has a doctor blade 18 bearing against it to provide an even thin layer of high viscosity toner on the pick-up roller or toner supply roller 16.

The pick-up roller or toner supply roller 16 is spaced apart from a metering roller 21. The metering roller 21 has a pattern of recesses on its surface and a doctor blade 23 bearing against the metering roller 21 scrapes essentially all of the high viscosity toner off the metering roller 21 except that toner which is within the recesses in the pattern of recesses on the metering roller 21. The metering roller 21 bears against a development member 31. The thickness of toner on the development member 31 after it has been transferred from the metering roller 21 is in the range of from 1 to 40 μm.

A carrier liquid displacement device 33 acts upon the thin layer of toner on the development member 31. In this embodiment a corona generating wire is placed in a position adjacent to the development member and a corona producing voltage is applied which can be used to adjust or reinforce the charge on the individual toner particles or change their location within the toner deposit. Device 33 acts upon the thin layer of toner on the development member to push toner particles in the thin layer towards the surface of the roller and to leave a carrier rich layer on the outside of the thin toner layer. The charge on the carrier liquid displacement device may be the same as that on the toner particles in the highly viscous toner. The corona generating wire or the like, may be placed at a distance of 3-7 mm from the thin layer of toner 37 on the development member 31, preferably about 4 mm, and a corona producing voltage is applied to the wire of about 3.5-7 kV, preferably 4-5 kV.

The imaging carrying member in the imaging stage 40 is an imaging roller 41 which has a surface 42 which will carry an electrostatic charge thereon. A charging device 43 provides an even electrostatic charge on the surface 42 of the imaging roller 41 and then a selective discharge device 44 discharges the electrostatic charge so that the surface 42 then has an electrostatic image thereon in the region generally shown as 45. The development member 31 bears against the imaging roller 41.

The developed toner image is then carried around on the surface 42 of the imaging roller 41 too the final transfer stage 60 in which the developed toner image is transferred from the imaging roller 41 to a substrate 61 which is held against the imaging roller 41. The substrate 61 may be a continuous web or individuals sheets of paper or other material. After the developed toner image has been transferred to the substrate 61, it is carried on the substrate and additionally, if required, the substrate passes between a pair of heated rollers in the fixing stage 70, and the toner is fixed permanently onto the substrate.

To assist with the transfer of the toner particles at the various stages from the toner supply through the toner metering apparatus, each of the rollers has a voltage induced upon it by means of a voltage regulating or controlling arrangement 38. A voltage is induced onto the development member 31 by the carrier liquid displacement device 33 which in this embodiment is a corona arrangement and the voltage is transferred down the toner film to the metering roller 21 and pick-up roller 16. A resistor 35 in an electrical circuit 36 between the development member 31 and a machine electrical common earth 37 regulates the voltage on the development member 31. A resistor 25 in an electrical circuit 26 between the metering roller 21 and a machine electrical common earth 37 regulates the voltage on the metering roller 21. A resistor 27 in an electrical circuit 28 between the pickup roller 16 and a machine electrical common earth 37 regulates the voltage on the pickup roller 16.

It has been surprisingly found that it is possible to supply a thin controlled layer of high viscosity high solids content toner by the use of roller systems as described, without the use of power supplies to create a voltage differential between the rollers, to move the electrostatically charged liquid toner particles to the latent image on the imaging member.

It has been found that the carrier liquid displacement device which acts upon the thin layer of liquid toner on the development member can supply the voltage differential between the rollers to assist in moving the electrostatically charged liquid toner particles to the latent image on the imaging member. The carrier liquid displacement device may take various forms, including the form of a corona generating device or the like, or it may take the form of a roller type mechanism. The carrier liquid displacement device is placed in a position adjacent to the development member, and a corona producing voltage, in the case where a corona generating device is used, is applied to establish an electric field across the toner. The corona generating wire or the like, may be placed at a distance of 3-7 mm from the thin layer of toner on the development member, preferably about 4 mm, and a corona producing voltage is applied to the wire of about 3.5-7 kV, preferably 4-5 kV.

The voltage differential along the feeder roller system due to the effect of the operation of the carrier liquid displacement device, can be controlled and regulated for each individual or group of rollers, that is, toner supply roller, pick-up roller, metering rollers and development rollers or members, by connecting machine earth via a regulating or controlling means to regulate or control the voltage on said roller or member. In its simplest form, the voltage regulating or control means may take the form of a resistor.

Alternatively, the voltage regulating or control means may take the form of a variable resistor. In a further alternative, the voltage regulating or control means may take the form of a zener type diode. In yet a further alternative, the voltage regulating or control means may take the form of a programmable voltage regulation circuit.

Figure 2:
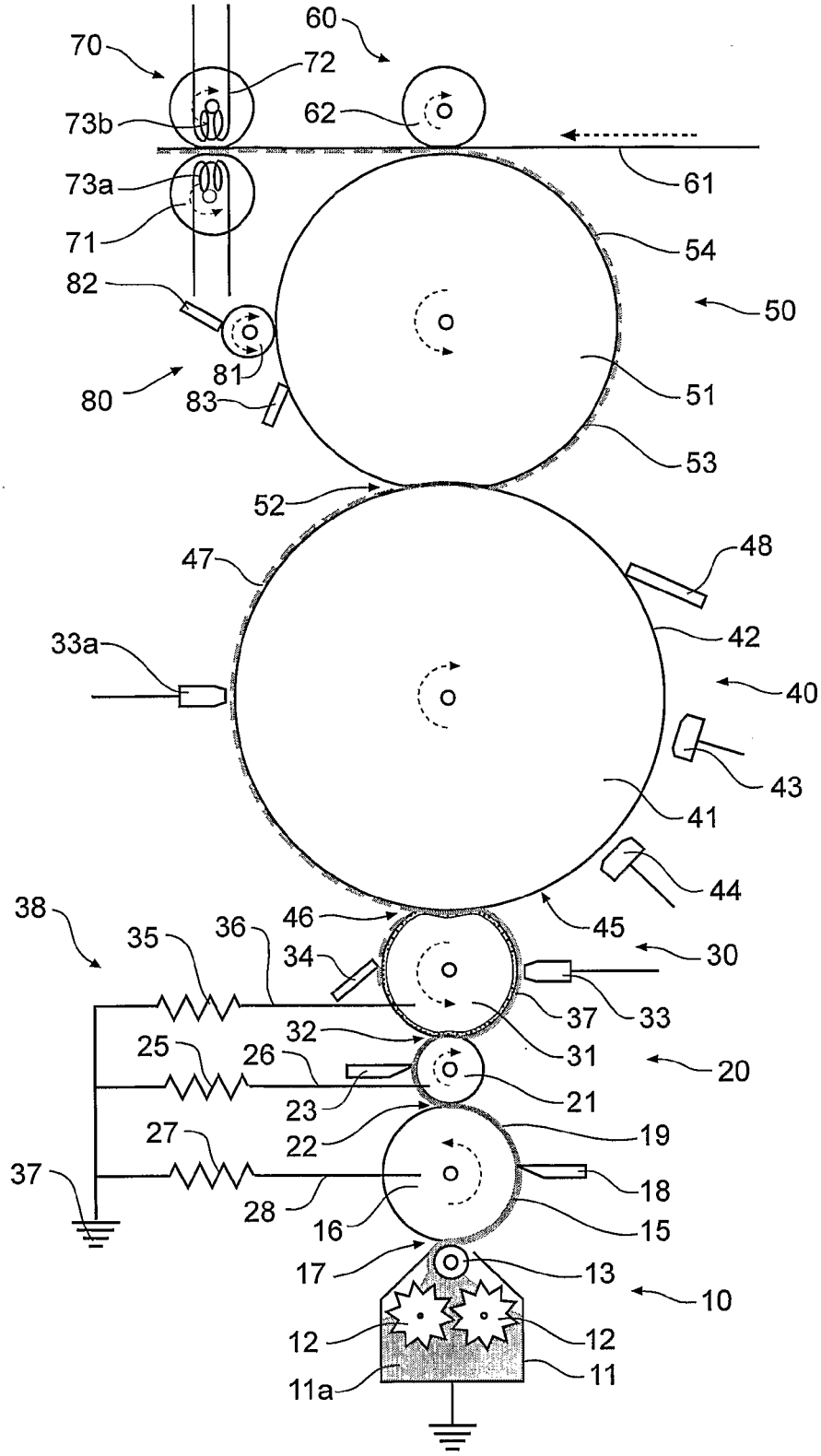
FIG. 2 shows a schematic representation of an alternative electrostatic printing apparatus according to the present invention.

FIG. 2 shows a more detailed schematic electrostatic printing process. The schematic electrostatic printing process is generally as described in FIG. 1 but with more detail and the same reference numerals are used for corresponding items. This drawing particularly shows a schematic toner travel path.

In FIG. 2, the schematic electrostatic printing process generally has a toner supply stage 10, a toner metering apparatus 20, a development stage 30, an imaging stage 40, an intermediate transfer stage 50, a transfer to substrate stage 60, a fixing stage 70 and a cleaner stage 80.

In the toner supply stage 10 a toner tank 11 has counter rotating gear wheels 12 which extend into toner 11*a* in the tank 11 and provide a supply of high viscosity toner to a supply roller 13. The supply roller extends out of the top of the toner tank 11 and is spaced apart from a pick-up roller 16 by a gap 17 which is in the range of from 100 to 500 μm. This produces a layer of toner on the pick-up roller of at least 100 μm. The toner supply stage may comprise other forms or methods of supplying, pumping or otherwise moving the toner from toner tank 11 to pick-up roller 16.

The pick-up roller 16 has a doctor blade 18 bearing against it to provide an even thin layer of high viscosity toner on the pick-up roller 16.

The pick-up roller 16 is spaced apart from a metering roller 21 by a gap 22 which is in the range of from 50 to 400 μm. The metering roller 21 has a pattern of recesses on its surface and a doctor blade 23 bearing against the metering roller 21 scrapes essentially all of the high viscosity toner off the metering roller 21 except that toner which is within the recesses in the pattern of recesses on the metering roller 21.

In one preferred embodiment the metering roller preferably has a trihelical pattern with a resolution of 200 lines per inch with a normal pattern depth of 30 μm.

Alternatively, a thin controlled layer of high viscosity high solids content toner can be delivered by the use of a feeder roller system which comprises a roller train comprising a number of smooth rollers. Hence the term metering roller is also intended to include a train of smooth rollers to produce a thin layer (1 to 40 μm) of toner for transfer to the development member.

The metering roller 21 bears against a development member 31 with an interference fit 32 which is within the range of 50 to 5000 μm. The interference fit is made possible because although the surface of the metering roller 21 is relatively hard, the surface of the development member 31 is relatively soft and the metering roller 21 pushes into the development member 31. The interference fit provides a contact time during the rotation of each roller during which toner may be transferred from the metering roller 21 to the development member 31. The thickness of toner on the development member 31 after it has been transferred from the metering roller 21 is in the range of from 1 to 40 μm.

A carrier liquid displacement device 33 acts upon the thin layer of toner 37 on the development member. In this embodiment a corona generating wire is placed in a position adjacent to the development member, and a corona producing voltage is applied which can be used to adjust or reinforce the charge on the individual toner particles or change their location within the toner deposit. Device 33 acts upon the thin layer of toner on the development member to push toner particles in the thin layer towards the surface of the roller and to leave a carrier rich layer on the outside of the thin toner layer. The charge on the carrier liquid displacement device may be the same as that on the toner particles in the highly viscous toner. The corona generating wire or the like, may be placed at a distance of 3-7 mm from the thin layer of toner 37 on the development member 31, preferably about 4 mm, and a corona producing voltage is applied to the wire of about 3.5-7 kV, preferably 4-5 kV.

A cleaner device 34 also acts against the development member 31 to clean toner off the developing roller after the development stage as discussed below.

The imaging carrying member in the imaging stage 40 is an imaging roller 41 which has a surface 42 which will carry an electrostatic charge thereon. A charging device 43 provides an even electrostatic charge on the surface 42 of the imaging roller 41 and then a selective discharge device 44 discharges the electrostatic charge so that the surface 42 then has an electrostatic image thereon in the region generally shown as 45. The image carrying member can have a surface 42 which is a dielectric in which case the charging device 43 is a corona discharge device, a charging roller or the like, and the selective discharge device 44 may be an ion gun, for instance. Alternatively, the image carrying member may have a surface 42 which is a photoconductor in which case the charging device 43 is a corona discharge device, a charging roller or the like, and the selective discharge device 44 may be a laser or LED device, for instance. Alternatively, the image carrying member may have a surface 42 which is a permanently polarised material as in the case with ferroelectrics or other electrets.

The development member 31 bears against the imaging roller 41 with an interference fit 46 which may be in the range of 50 to 5000 μm.

The imaging roller 41 has a relatively hard surface and the development member 31 has a relatively soft surface so that the imaging roller pushes slightly into the development member 31. This gives an interference fit and hence a residence or increased contact time between the rollers during which time the electrostatic image is developed by marking particles in the thin layer of toner being attracted to the electrostatic image to give a developed toner image.

Alternatively, the image carrying member may be an imaging belt, which has a surface that carries an electrostatic charge thereon. In this configuration, the imaging belt is held against the development member and the intermediate transfer roller by means of two pressure rollers which engage against the rear side of the imaging belt at the respective contact regions.

The developed toner image is then carried around on the surface 42 of the imaging roller 41 and passes under carrier liquid displacement device 33*a*. The carrier liquid displacement device in this embodiment is illustrated as a corona discharge device. This acts to push toner down to the surface 42 of the imaging roller 41 so that it is compacted before it is transferred at the intermediate transfer stage 50.

The compacted developed toner image 47 is then carried around on the surface 42 of the imaging roller 41 until the intermediate transfer roller 51 is reached. The intermediate transfer roller 51 engages against the imaging roller 41 with an interference fit 52. Again, the interference fit between the imaging roller 41 and the intermediate transfer roller 51 provides a contact time in which toner particles of the developed toner image are transferred to the intermediate transfer roller 51 under the influence of an electric field. The interference fit of the imaging roller against the intermediate transfer roller 51 may be from 50 to 5000 μm. The developed toner image on the surface 42 of the imaging roller 41 is hence transferred to the surface 53 of the intermediate transfer roller 51 and carried around to the final transfer stage 60.

After the developed toner image on the surface 42 of the imaging roller 41 has been transferred to the intermediate transfer roller 51 a cleaner arrangement 48 shown schematically is used to remove excess toner from the imaging roller before it is recharged.

In the final transfer stage 60, the developed toner image is transferred from the intermediate transfer roller 51 to a substrate 61 which is held against the intermediate transfer member 51 by means of a pressure roller 62 which engages against the rear side of the substrate 61. It should be understood that transfer may be of the electrostatic type, pressure type, transfix type, combinations thereof, or other known methods and techniques of transferring and fusing toner images. The substrate 61 may be a continuous web or individuals sheets of paper or other material.

After the developed toner image has been transferred to the substrate 61, it is carried on the substrate and additionally, if required, the substrate passes between a pair of heated rollers 71 and 72 in the fixing stage 70, and the toner is fixed permanently onto the substrate. The heated rollers 71 and 72 have heater elements 73*a* and 73*b* to provide heat to fix the toner onto the substrate.

In the cleaner stage 80 for the intermediate transfer member 51 a cleaner roller 81 bears against the surface 53 of the intermediate transfer member 51. The cleaner roller 81 has a voltage impressed upon it which is different to that on the intermediate transfer member 51 so that toner particles are attracted to the cleaner roller 81 and then removed from that roller by a cleaner blade 82. The cleaner roller 81 can be adapted to rotate at a differential speed to the intermediate transfer member 51, such as rotating at a different speed in the same direction or counter-rotating. After the cleaner roller 81, a cleaner blade 83 is also used to ensure thorough cleaning of the intermediate transfer roller 51.

It has been found that if cleaner roller 81 is used to remove a significant amount of any residual material from intermediate transfer member 51, cleaner blade 83 exhibits an exceptionally long life within the apparatus. Such a roller followed by a blade mechanism significantly reduces the cost associated with cleaner blade replacement in a high speed printing apparatus.

The toner travel path for this embodiment of the invention is shown on FIG. 2 by means of a shaded line. The gear wheels 12 feed toner from the tank 11 to the supply roller 13 upon which it is carried to the pick-up roller 16 and then carried on the pick-up roller 16 in an anti-clockwise direction past doctor blade 18 until it reaches the metering roller 21. It is then transferred to the metering roller 21 which rotates in a clockwise direction and the doctor blade 23 on the metering roller 21 again reduces the thickness of toner. The toner is carried in a clockwise direction on the metering roller 21 to the development member 31 where it transfers to the development member during the residence time provided by the interference fit between the metering roller and the development member, as discussed above, to give a thin layer of liquid toner on the development member 31.

The thin layer of liquid toner is then carried in an anti-clockwise direction on the development member past the carrier liquid displacement corona 33, as discussed earlier, until it reaches the imaging roller 41. At this stage, some of the toner particles are transferred in an image-wise manner to the imaging roller 41, but not all is transferred and hence, some toner continues on around the development member 31 to the cleaner 34. The transferred toner 47 is carried in a clockwise direction around the imaging roller 41 past the carrier liquid displacement corona 33*a*, as discussed earlier, to the intermediate transfer roller 51 where the toner 54 is transferred to the intermediate transfer roller 51 and is carried in an anti-clockwise direction on the intermediate transfer roller 51 until it reaches the substrate 61. The toner is then transferred to the substrate 61 and proceeds to the fixing station 70 as discussed above. Any remaining toner on the intermediate transfer roller is cleaned off by cleaner arrangement generally shown as 80 which includes a cleaner roller 81 and a scraper 82 on the cleaner roller, and a further cleaning blade 83 bearing against intermediate transfer roller 51.

In a similar manner to that discussed in relation to FIG. 1 to assist with the transfer of the toner particles at the various stages from the toner supply through the toner metering apparatus, each of the rollers has a voltage induced upon it by means of a voltage regulating or controlling arrangement 38. A voltage is induced onto the development member 31 by the carrier liquid displacement device 33 which in this embodiment is a corona arrangement and the voltage is transferred down the toner film to the metering roller 21 and pick-up roller 16. A resistor 35 in an electrical circuit 36 between the development member 31 and a machine electrical common earth 37 regulates the voltage on the development member 31. A resistor 25 in an electrical circuit 26 between the metering roller 21 and a machine electrical common earth 37 regulates the voltage on the metering roller 21. A resistor 27 in an electrical circuit 28 between the pickup roller 16 and a machine electrical common earth 37 regulates the voltage on the pickup roller 16.

Figure 3:
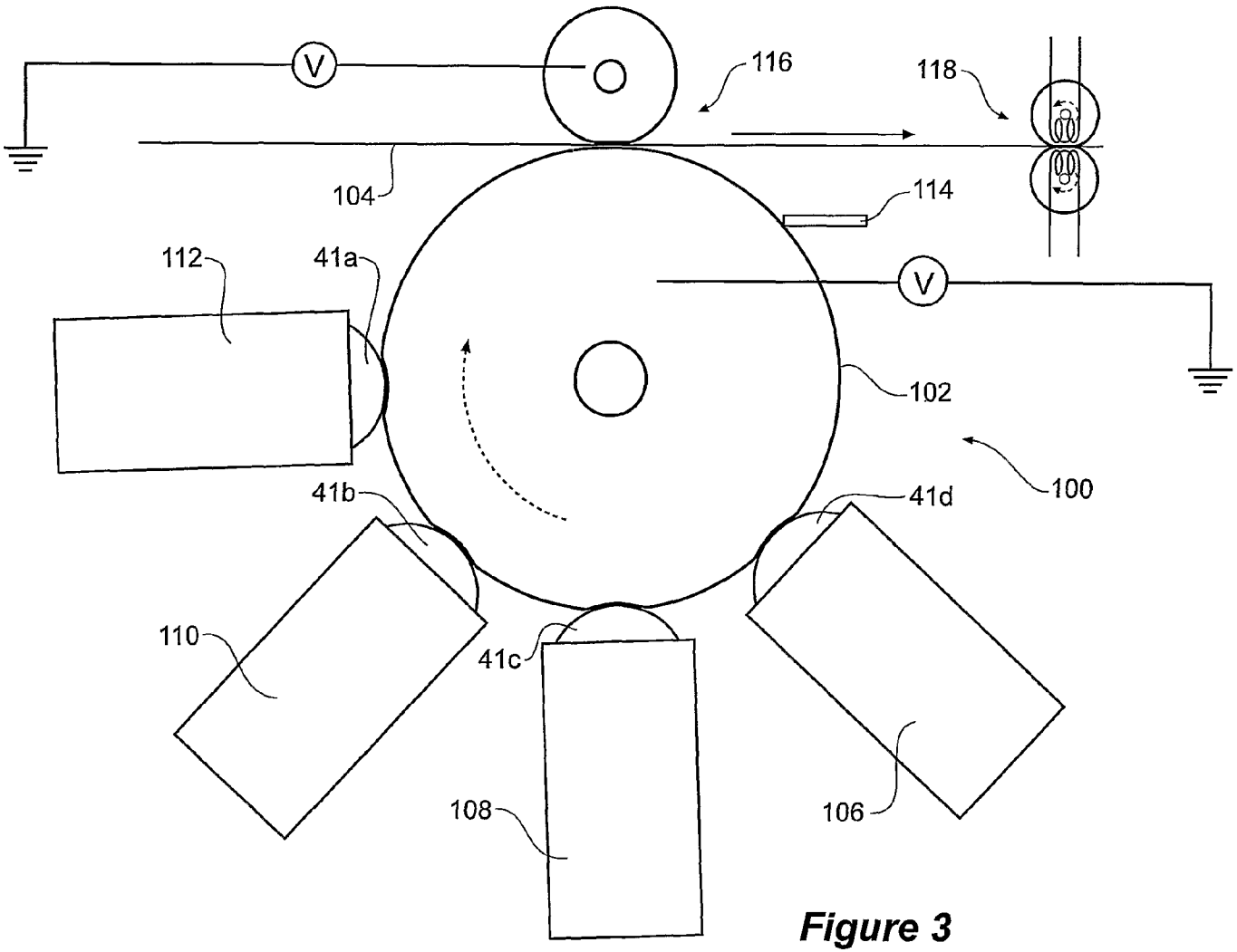
FIG. 3 shows one embodiment of a multi-colour printing apparatus incorporating electrostatic printing stages according to the present invention.
Figure 4:
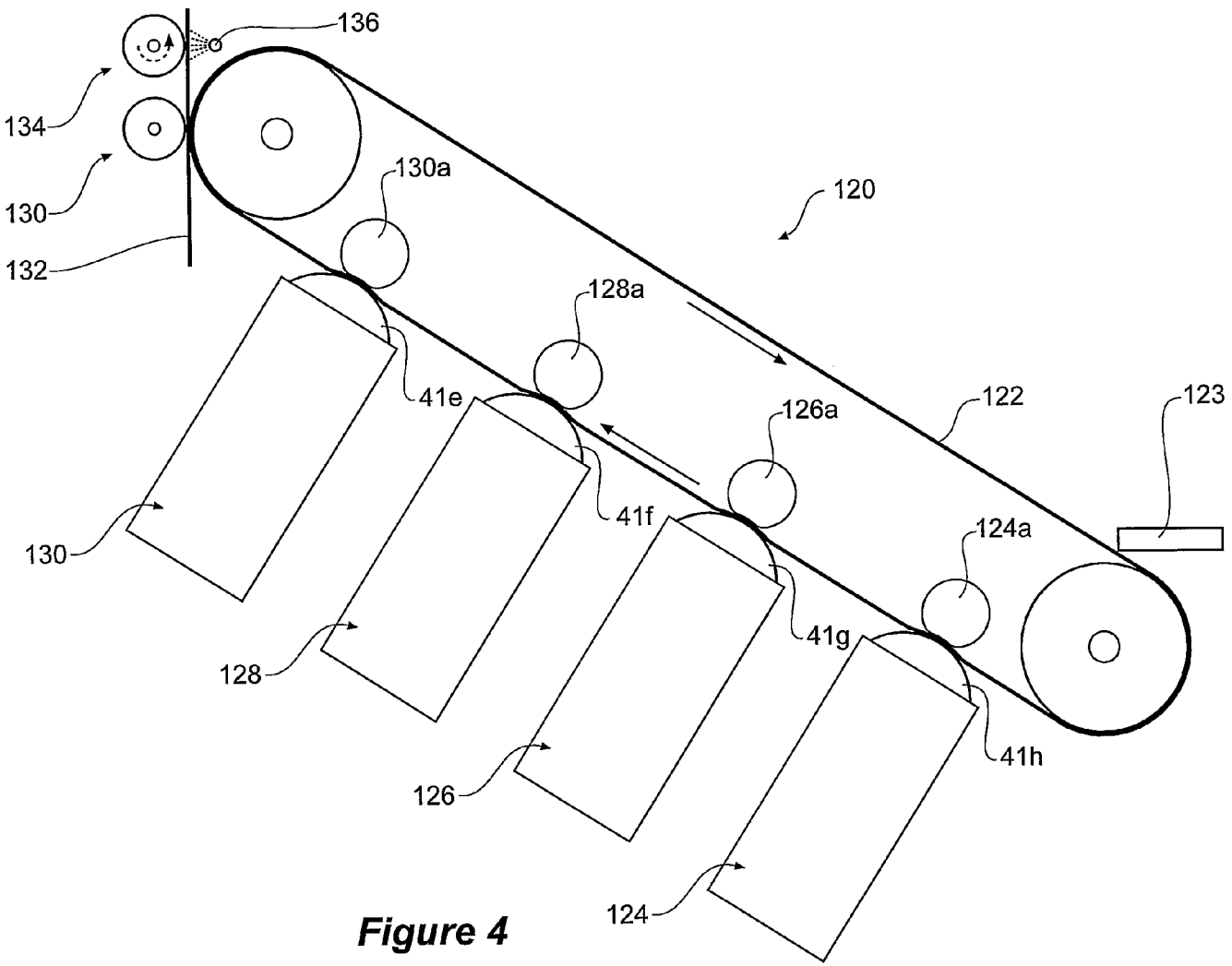
FIG. 4 shows an alternative embodiment of a multi-colour printing apparatus incorporating electrostatic printing stages according to the present invention.
Figure 5:
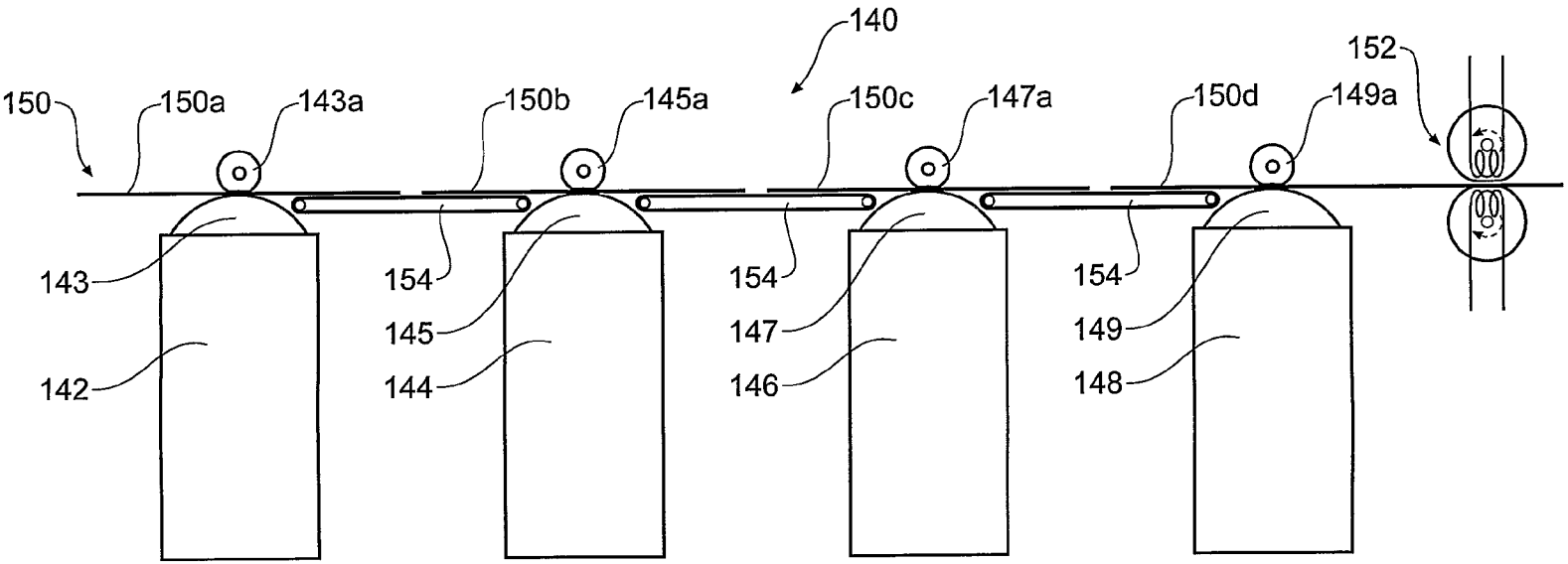
FIG. 5 shows a further alternative embodiment of a multi-colour printing apparatus incorporating electrostatic printing stages according to the present invention.

FIGS. 3, 4 and 5 show various arrangements for multi-colour electrostatic printing incorporating the schematic electrostatic printing apparatus of FIGS. 1 and 2.

In FIG. 3, a colour printing arrangement 100 consists of a single intermediate transfer drum 102 upon which four colours, or more if required, are sequentially placed to provide a colour image which is subsequently transferred to a substrate 104. Each of the printing stages 106, 108, 110 and 112 can be any of the embodiments shown in FIGS. 1 and 2. A first printing stage 106 provides a first colour, a second colour printing stage 108 provides a second colour, a third printing stage 110 provides a third colour and a fourth printing stage 112 provides a fourth colour for the image being built up on the surface of the intermediate transfer roller 102. In each printing stage 106, 108, 110 and 112 the imaging roller 41*a*, 41*b*, 41*c* and 41*d* respectively engages against the single intermediate transfer drum 102 with an interference fit. The multi colour image is then transferred to the final substrate and the cleaner 114 cleans the intermediate transfer roller 102 before another image is built up on the intermediate transfer roller 102.

Each of the colour imaging stations 106, 108, 110 and 112 operates in a manner as discussed in relation to the embodiments shown in FIGS. 1 and 2 up to the imaging stage 40 and then all of the separate colour images are transferred to the single image transfer roller 102. The final transfer station 116 and the fixing station 118 operate in a similar manner to the respective stages 60 and 70 as shown in FIG. 2.

FIG. 4 shows an alternative arrangement of a multi-colour printing apparatus. In this embodiment the multi colour printing apparatus 120 uses a belt 122 as the intermediate transfer member. The belt may be an elastomeric material, or other suitable transfer material as known in the art. Colour imaging stations 124, 126, 128 and 130 (or more colour stations) supply single colour images to an image being built up on the belt 122. The composite image is then carried on the belt 122 to a final transfer station 130 where it is transferred onto a substrate 132 before going to a fixing station 134. The cleaner 123 cleans the intermediate transfer belt 122 before another image is transferred sequentially onto the intermediate transfer belt 122. Each of the colour imaging stations 124, 126, 128 and 130 operates in a manner as discussed in relation to the embodiments shown in FIGS. 1 and 2 up to the imaging stage 40 and then all of the separate colour images are transferred to the belt 122 as the intermediate transfer member. In each printing stage 124, 126, 128 and 130 the imaging roller 41*e*, 41*f*, 41*g* and 41*h* respectively engages against the belt 122. The final transfer station 130 and the fixing station 134 operate in a similar manner to the respective stages 60 and 70 as shown in FIG. 2. At the stage of transfer of the individual colour images from the printing stages 124, 126, 128 and 130 to the belt 122 pressure rollers 124*a*, 126*a*, 128*a* and 130*a* respectively enable an interference fit of the imaging rollers 41*e*, 41*f*, 41*g* and 41*h* onto the image transfer belt 122.

It will be noted that in this embodiment the fixing station 134 includes a UV emission device 136. In this case the liquid developer supplied by the imaging stations 124, 126, 128 and 130 would provide a UV curable liquid developer rather than a heat and pressure curable liquid developer. It should be understood that transfer may be of the electrostatic type, the transfix type, combinations thereof, or other known methods of transferring and fusing toner images.

In FIG. 5 a multi-colour printing apparatus 140 is shown. In this embodiment colour imaging stations 142, 144, 146 and 148 provide developed images onto their respective intermediate transfer members 143, 145, 147 and 149 and the developed image on the intermediate transfer members 143, 145, 147 and 149 are consecutively transferred to a final substrate 150. In this embodiment various colours of the image are built up on the final substrate before a fixing station 152. Also in this embodiment it will be noted that the final substrates are individual sheets of paper 150*a*, 150*b*, 150*c* and 150*d* rather than a continuous web as shown in the earlier embodiments. The sheets of paper are carried on conveyors 154 between the respective final transfer stations and then to the fixing station 152. The paper or other substrate material could be a web of paper or other substrate material.

Each of the colour imaging stations 142, 144, 146 and 148 operates in a manner as discussed in relation to the embodiments shown in FIGS. 1 and 2 up to the final transfer stage 60 (FIG. 2). At the stage of transfer of the individual colour images from the intermediate transfer rollers 143, 145, 147 and 149 to the final substrate 150 pressure rollers 143*a*, 145*a*, 147*a* and 149*a* respectively enable an interference fit of the intermediate transfer rollers 143, 145, 147 and 149 onto the final substrate 150.

Figure 6:
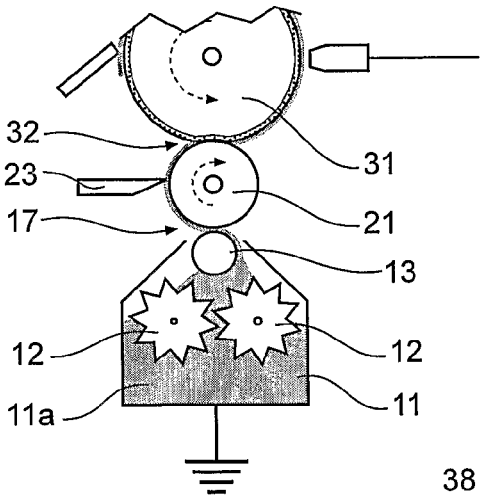
FIG. 6 shows detail of an alternative toner supply mechanism before the development member.

FIG. 6 depicts an alternative embodiment of the toner supply portion of the present invention. In FIG. 6, the schematic electrostatic printing process is generally as described in FIG. 1 and the same reference numerals are used for corresponding items.

In the toner supply stage 10 a toner tank 11 has counter rotating gear wheels 12 which extend into toner 11*a* in the tank 11 and provide a supply of high viscosity toner to a supply roller 13. The supply roller extends out of the top of the toner tank 11 and is spaced apart from a metering roller 21 by a gap 17 which is in the range of from 50 to 400 μm. This produces a layer of toner on the metering roller of at least 50 μm. The toner supply stage may comprise other forms or methods of supplying, pumping or otherwise moving the toner from toner tank 11 to metering roller 21.

The metering roller 21 has a pattern of recesses on its surface and a doctor blade 23 bearing against the metering roller 21 scrapes essentially all of the high viscosity toner off the metering roller 21 except that toner which is within the recesses in the pattern of recesses on the metering roller 21. The metering roller preferably has a trihelical pattern with a resolution of 200 lines per inch with a normal pattern depth of 30 μm.

The metering roller 21 bears against a development member 31 with an interference fit 32 which is within the range of 50 to 5000 μm. The interference fit is made possible because although the surface of the metering roller 21 is relatively hard, the surface of the development member 31 is relatively soft and the metering roller 21 pushes into the development member 31. The interference fit provides a contact time during the rotation of each roller during which toner may be transferred from the metering roller 21 to the development member 31. The thickness of toner on the development member 31 after it has been transferred from the metering roller 21 is in the range of from 1 to 40 μm.

Subsequent steps in the operation of the electrostatic printing process are as described in relation to FIG. 1 or 2.

Figure 7:
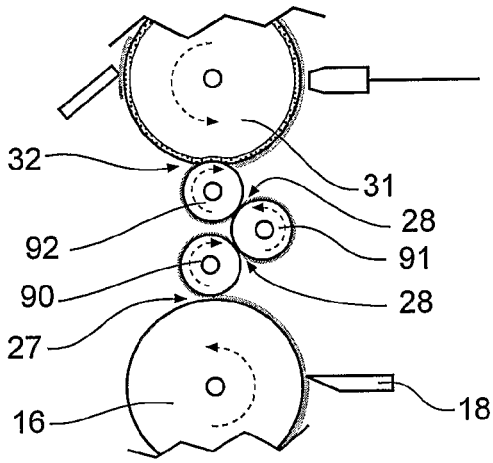
FIG. 7 shows detail of a further alternative toner supply mechanism.

FIG. 7 is an alternative embodiment of the toner supply portion of the present invention. In FIG. 7, the schematic electrostatic printing process is generally as described in FIG. 2 and the same reference numerals are used for corresponding items.

The toner supply stage is as discussed in relation to FIG. 2 up to the pick-up roller 16. The pick-up roller 16 has a doctor blade 18 bearing against it to provide an even thin layer of high viscosity toner onto the pick-up roller 16.

The pick-up roller 16 in this embodiment can be in "kiss" contact or with an interference fit against a multi roller feed train of at least three or more smooth rollers. In this embodiment there are three smooth rollers 90, 91 and 92. The train of smooth rollers produce a thin layer (1 to 40 μm) of toner for transfer to the development member. The pick-up roller 16 is in "kiss" contact with the first smooth roller 90. Each of the smooth rollers 90, 91 and 92 are in "kiss" contact or with an interference fit with each other. The interference fit between the three smooth rollers can be up to 1,000 μm. The degree of interference will determine the thickness of the toner layer that is presented to the development member 31. The feed rollers 90, 91 and 92 may comprise elastomer rollers coated with polyurethane or NBR or other suitable material. The electrical resistivity of the coating may be in the region of $10^4$ to $10^8$ ohm centimetres.

The final smooth roller 26 bears against a development member 31 with an interference fit 32 which is up to 1000 μm. The interference fit is made possible because although the surface of the final smooth roller 92 is relatively hard, the surface of the development member 31 is relatively soft and the final smooth roller 92 pushes into the development member 31. The interference fit provides a contact time during the rotation of each roller during which toner may be transferred from the final smooth roller 92 to the development member 31. The thickness of toner on the development member 31 after it has been transferred from the final smooth roller 92 is in the range of from 1 to 40 μm.

Subsequent steps in the operation of the electrostatic printing process are as described in relation to FIG. 2.

Figure 8:
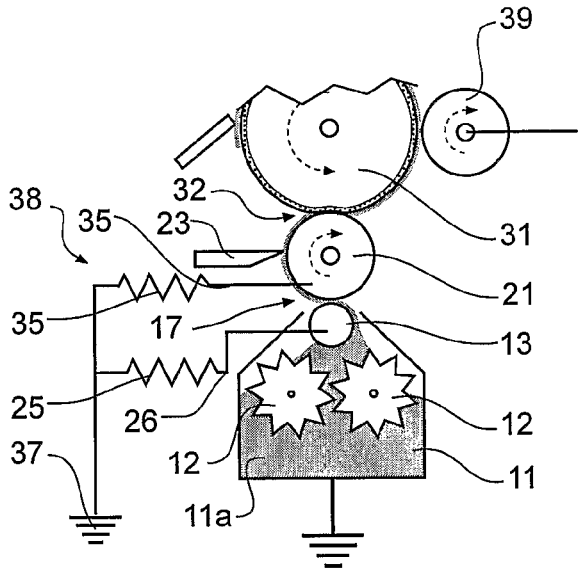
FIG. 8 shows detail of a further alternative toner supply mechanism and voltage regulating or controlling means according to one embodiment of the present invention.

FIG. 8 is a further alternative embodiment of the toner supply portion and voltage regulating or controlling means of the present invention. In FIG. 6, the schematic electrostatic printing process is generally as described in FIG. 1 and the same reference numerals are used for corresponding items.

In the toner supply stage 10 a toner tank 11 has counter rotating gear wheels 12 which extend into toner 11*a* in the tank 11 and provide a supply of high viscosity toner to a supply roller 13. The supply roller extends out of the top of the toner tank 11 and is spaced apart from a metering roller 21 by a gap 17 which is in the range of from 50 to 400 μm. This produces a layer of toner on the metering roller of at least 50 μm. The toner supply stage may comprise other forms or methods of supplying, pumping or otherwise moving the toner from toner tank 11 to metering roller 21.

The metering roller 21 has a pattern of recesses on its surface and a doctor blade 23 bearing against the metering roller 21 scrapes essentially all of the high viscosity toner off the metering roller 21 except that toner which is within the recesses in the pattern of recesses on the metering roller 21. The metering roller preferably has a trihelical pattern with a resolution of 200 lines per inch with a normal pattern depth of 30 μm.

The metering roller 21 bears against a development member 31 with an interference fit 32 which is within the range of 50 to 5000 μm. The interference fit is made possible because although the surface of the metering roller 21 is relatively hard, the surface of the development member 31 is relatively soft and the metering roller 21 pushes into the development member 31. The interference fit provides a contact time during the rotation of each roller during which toner may be transferred from the metering roller 21 to the development member 31. The thickness of toner on the development member 31 after it has been transferred from the metering roller 21 is in the range of from 1 to 40 μm. Subsequent steps in the operation of the electrostatic printing process are as described in relation to FIG. 1 or 2.

In this embodiment the electrostatic charging device 39 acting onto the development member 31 to impress an electrostatic charge onto the development member is a carrier liquid displacement roller bearing against the development member and having a voltage applied to it of from +50 to +1500 volts.

To assist with the transfer of the toner particles at the various stages from the toner supply through the toner metering apparatus, each of the rollers has a voltage induced upon it by means of a voltage regulating or controlling arrangement 38. A voltage is induced onto the development member 31 by the carrier liquid displacement roller 39 and the voltage is transferred down the toner film to the metering roller 21 and supply roller 13. A resistor 35 in an electrical circuit 36 between the development member 31 and a machine electrical common earth 37 regulates the voltage on the development member 31. A resistor 25 in an electrical circuit 26 between the supply roller 13 and a machine electrical common earth 37 regulates the voltage on the supply roller 21.

Figure 9:
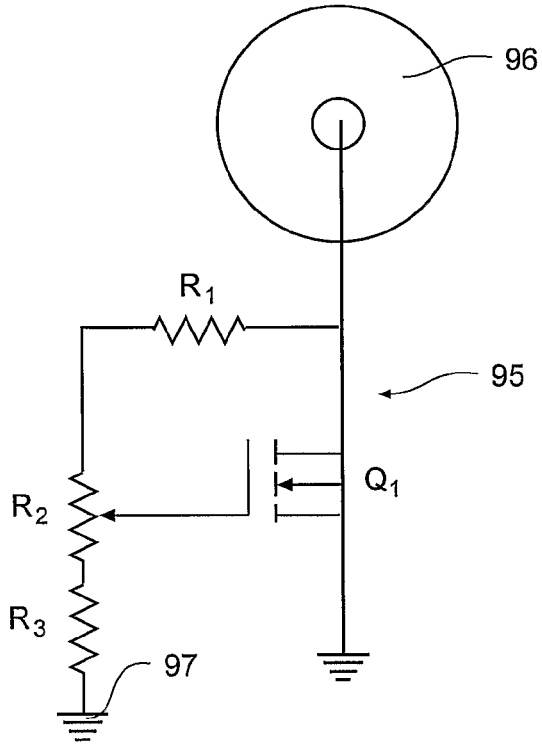
FIG. 9 shows detail of a basic programmable voltage control and regulation circuit.

FIG. 9 illustrates a simple programmable voltage regulation circuit 95 that can be used in the present invention. The voltage on the roller or member 96, or group of rollers or members is maintained and regulated at the required level by the values of R1, R2 and R3 and the threshold value of Q1. Q1 is an N-channel MOSFET. By varying the value of resistor R2, the voltage on the roller or member can be adjusted and maintained. By this arrangement the regulated voltage has a low dependence on the shunt current (roller to machine earth). The resistor R3 and the N-channel MOSFET Q1 are connected to the machine earth 97.

Figure 10:
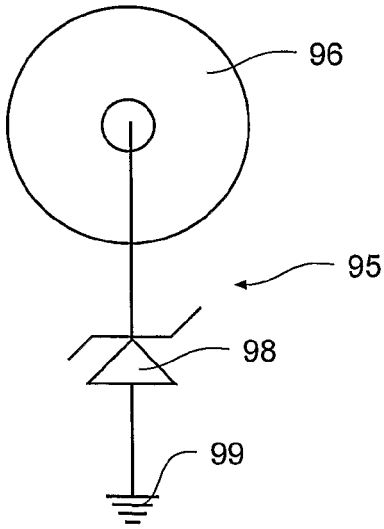
FIG. 10 shows an alternative voltage control and regulation arrangement.

FIG. 10 shows an alternative voltage regulation circuit 95 that can be used in the present invention. The voltage on the roller or member 96, or group of rollers or members is maintained and regulated at the required level by a Zener diode 98 connected between the roller 96 and the machine earth 99.

Figure 11:
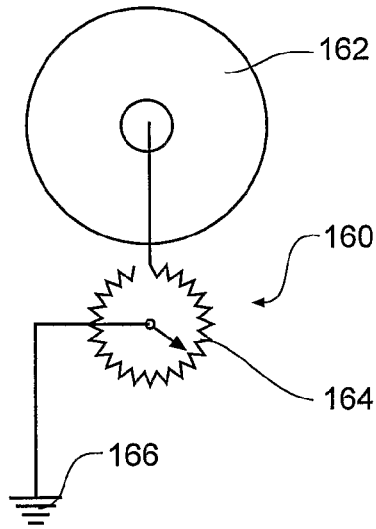
FIG. 11 shows a further alternative voltage control and regulation arrangement.

FIG. 11 shows a further alternative voltage regulation circuit 160 that can be used in the present invention. The voltage on the roller or member 162, or group of rollers or members is maintained and regulated at the required level by the setting of a variable resistor 164 connected between the roller 162 and the machine earth 166.

It has been found that by using a voltage regulating or control means as described herein, allows for the significant lowering of the surface voltage potential on the imaging member without the loss of image quality or increased background noise; indeed, the image quality and image density increase. The lowering of the latent image surface voltage on the imaging member has the additional benefit of decreasing potential photoconductor fatigue which is associated with high charging voltages. The lowering of the surface potential on the imaging member increase the useable life of the photoconductor.

This then generally describes various embodiments of the invention but to further assist with understanding, reference will now be made to the accompanying comparison and non-limiting examples to illustrate the advance in the art by this invention.

The following table illustrates the differential bias voltage (Dif.) induced by the carrier liquid displacement device, in the form of a corona generating wire with a potential of 4.2 kV, with respect to a machine electrical common earth potential, between the development roller (DB) and the anilox or patterned roller (AB) for a given fixed resistor value.

| Resistor (ohm) | DB(V) | AB(V) | Dif.(V) |
|---|---|---|---|
| $1.0 \times 10^5$ | 1.2 | 6.2 | 5 |
| $4.0 \times 10^5$ | 1.1 | 28 | 27 |
| $7.5 \times 10^5$ | 1.3 | 50 | 49 |
| $1.0 \times 10^6$ | 1.4 | 63 | 62 |
| $2.0 \times 10^6$ | 4.9 | 110 | 105 |
| $4.0 \times 10^6$ | 23 | 160 | 137 |
| $6.0 \times 10^6$ | 45 | 189 | 144 |
| $8.0 \times 10^6$ | 70 | 215 | 145 |
| $1.0 \times 10^7$ | 91 | 237 | 146 |
| $2.0 \times 10^7$ | 161 | 306 | 145 |
| $4.0 \times 10^7$ | 227 | 369 | 142 |
| $6.0 \times 10^7$ | 267 | 408 | 141 |
| $8.0 \times 10^7$ | 284 | 425 | 141 |
| $1.0 \times 10^8$ | 301 | 442 | 141 |

This table illustrates that by using a resistance in the range of from $1\times10^5$ to $1\times10^8$ ohms, a voltage can be induced on each of the development roller and the anilox or patterned roller and the voltage difference is such that transfer of toner from the metering anilox or patterned roller to the development roller is assisted. The voltage difference can be in the range of from 0 to 146 v. The resistance used is very dependent on the toner formulation, and the difference in voltage between the rollers can be, for certain toners, zero. Also, for a given resistance, the charging corona voltage can also be varied to determine the induced voltage on the rollers.

The following table illustrates the differential bias voltage (Dif.), induced by the carrier liquid displacement device, in the form of a corona generating wire (CG), with respect to a machine electrical common earth potential, between the development roller (DB) and the anilox or patterned roller (AB) for a fixed resistor value of $2.0\times10^7$ ohms.

| CG (kV) | DB(V) | AB(V) | Dif. |
|---|---|---|---|
| 3.5 | 39 | 159 | 120 |
| 3.80 | 76 | 215 | 139 |
| 4.00 | 111 | 260 | 149 |
| 4.20 | 160 | 310 | 150 |
| 4.50 | 252 | 419 | 167 |

The following table illustrates the results of print tests using standard bias power supplies (PS) as per the prior art (Examples 1, 3, 5 and 7) in comparison to results obtained with a fixed resistor (R) of $1.0\times10^7$ ohms value (Examples 2, 4, 6 and 8), to give a surface potential (SP) between the development roller (DB) and the anilox or patterned roller (AB) to the machine electrical common earth potential (Examples 2, 4, 6 and 8). The resultant images were tested for image optical density (ODU) and for unwanted background staining (Fog). Measurements were taken using a Gretag-Macbeth Spectrolino Densitometer made by Gretag-Macbeth, Switzerland.

| Example | Type | SP V | Image ODU | Fog ODU |
|---|---|---|---|---|
| 1 | PS | 200 | 0.75 | 0.01 |
| 2 | R | 200 | 1.67 | 0.00 |
| 3 | PS | 250 | 1.13 | 0.01 |
| 4 | R | 250 | 1.69 | 0.00 |
| 5 | PS | 350 | 1.30 | 0.01 |
| 6 | R | 350 | 1.63 | 0.00 |
| 7 | PS | 450 | 1.71 | 0.01 |
| 8 | R | 450 | 1.73 | 0.00 |

The above print sample results clearly illustrate that by using a voltage regulating or control means as described herein, allows for the significant lowering of the surface voltage potential on the imaging member without the loss of image quality or increased background noise; indeed, the image quality and image density increase, as well as eliminating unwanted background staining or fog. Additionally, the ability to use a lower latent image surface voltage on the imaging member, whilst maintaining high image quality and density, has the additional benefit of decreasing photoconductor fatigue which can be associated with high charging voltages and thus increasing the useable life of the photoconductor. Further, the simplified system described herein, allows for significantly reduced hardware and maintenance costs, especially in the office automation area where the total cost of ownership can be significantly reduced with the present invention.

In a preferred embodiment of the present invention the development member may have the following preferable characteristics:

| Development member | Range | Preferred |
|---|---|---|
| Roughness | Rz ≦ 2 μm | Rz ≦ 2 μm |
| Hardness of coating | 10-70° Shore A | 50° Shore A |
| Surface energy | 10-50 mN/m | 35 mN/m |
| Electrical resistivity | $1 \times 10^4$-$1 \cdot 10^8$ Ω · cm | $1 \times 10^6$ Ω · cm |

In a preferred embodiment of the present invention, the intermediate transfer member may be a roller or belt, and may have the following preferable characteristics:

| Intermediate Member | Range | Preferred |
|---|---|---|
| Roughness | Rz ≦ 2 μm | Rz ≦ 2 μm |
| Hardness of coating | 10-70° Shore A | 60° Shore A |
| Surface energy | 10-50 mN/m | 25 mN/m |
| Electrical resistivity | $1 \times 10^4$-$1 \cdot 10^8$ Ω · cm | $1 \times 10^7$ Ω · cm |

In order to achieve good cleaning and release properties, rollers may have additional over coatings. The preferred materials to be used for overcoating are polyurethane and fluorinated rubbers (silicone rubbers could be used also).

All measurements herein were taken at room temperature (25° C.). Viscosities were measured using a HAAKE Rheo-Stress RS600.

The present invention advances the state of the useful arts, by providing a method of developing an electrostatic latent image by simplifying the design of the print engine and reducing overall running costs.

It can be appreciated that changes to any of the above embodiments can be made without departing from the scope of the present invention as defined by the claims and that other variations of the specific construction disclosed herein can be made by those skilled in the art without departing from the invention.

The invention claimed is:

1. An electrostatographic printing machine comprising a toner supply chain incorporating at least a toner supply device, a metering roller and a development member and an image carrying member, an electrostatic charging device acting onto the development member to impress an electrostatic charge onto the development member and to induce a voltage thereon with respect to a machine electrical common earth potential, wherein said electrostatographic printing machine further comprises a toner supply roller; wherein the toner supply roller, the metering roller and the developer member are each electrically connected to the machine electrical common earth potential, each via respective voltage regulating or controlling means to regulate or control induced voltages on each of the toner supply roller, the metering roller and the developer member; and wherein each of the respective voltage regulating or control means comprises a resistor, a variable resistor, a zener type diode, or a programmable voltage regulation circuit.

2. The electrostatographic printing machine as in claim 1, wherein the electrostatic charging device acting onto the development member to impress an electrostatic charge onto the development member is selected from a carrier liquid displacement device, a corona discharge device or a carrier liquid displacement roller bearing against the development member and having a voltage applied to it of from +50 to +1500 volts.

3. The electrostatographic printing machine as in claim 1, wherein the resistance of the resistor is from $1\times10^{5}$ to $1\times10^{8}$ ohms whereby to induce a voltage difference of from 0 to 146 volts between the metering roller and the development roller.

4. An electrostatographic printing machine comprising;

(a) a toner supply device to supply a toner comprising a carrier and toner particles to a toner supply roller;

(b) a metering roller which receives a thin layer of the toner from the toner supply roller;

(c) a development member and an electrostatic charging device acting onto the development member to impress an electrostatic charge onto the development member and to induce a voltage thereon with respect to a machine electrical common earth potential;

(d) the metering roller bearing against the development member to transfer a thin layer of the toner onto the development member;

(e) an image carrying member having a surface adapted to retain an electrostatic latent image thereon and an electrostatic charging device acting onto the image carrying member to impress an electrostatic charge onto the image carrying member;

(f) an image forming stage in which the electrostatic charge is formed into an electrostatic latent image on the image carrying member;

(g) the development member engaging against the image carrying member;

(h) a development stage in which toner particles in the thin layer on the development member are transferred to the image carrying member under the influence of the electrostatic latent image on the image carrying member to provide a developed image thereon; and (i) a transfer stage in which the developed image is transferred from the image carrying member onto a substrate, wherein the toner supply roller, the metering roller and the developer member are each electrically connected to the machine electrical common earth potential, each via respective voltage regulating or controlling means to regulate or control a voltage on each of the toner supply roller, the metering roller and the developer member; and wherein each of the respective voltage regulating or control means comprises a resistor, a variable resistor, a zener type diode, or a programmable voltage regulation circuit.

5. The electrostatographic printing machine as in claim 4, wherein the electrostatic charging device acting onto the development member to impress an electrostatic charge onto the development member comprises a carrier liquid displacement device.

6. The electrostatographic printing machine as in claim 4, wherein the electrostatic charging device acting onto the development member to impress an electrostatic charge onto the development member comprises a corona discharge device.

7. The electrostatographic printing machine as in claim 4, wherein the electrostatic charging device acting onto the development member to impress an electrostatic charge onto the development member comprises a carrier liquid displacement roller bearing against the development member and having a voltage applied to it of from +50 to +1500 volts.

8. The electrostatographic printing machine as in claim 4, wherein the resistance of the resistor is from $1\times10^{5}$ to $1\times10$ ohms whereby to induce a voltage difference of from 0 to 146 volts between the metering roller and the development roller.

* * * * *